United States Patent [19]

Palange

[11] 4,193,273

[45] Mar. 18, 1980

[54] APPARATUS FOR USE IN PRODUCING KNIT FABRICS

[76] Inventor: Walter Palange, 655 Park Shore Dr., Naples, Fla. 33940

[21] Appl. No.: 886,776

[22] Filed: Mar. 15, 1978

[30] Foreign Application Priority Data

Jun. 28, 1977 [IT] Italy ..... 16905 A/77
Oct. 21, 1977 [IT] Italy ..... 51513 A/77

[51] Int. Cl.[2] ..... D04B 3/00
[52] U.S. Cl. ..... 66/4
[58] Field of Search ..... 66/1 A, 3, 4, 117, 118, 66/214

[56] References Cited

U.S. PATENT DOCUMENTS

| | | | |
|---|---|---|---|
| 2,138,108 | 11/1938 | Lapham | 66/1 A UX |
| 2,318,018 | 5/1943 | Semonsen | 66/4 |
| 2,457,064 | 12/1948 | Parisi | 66/4 |
| 2,539,479 | 1/1951 | Robertson | 66/1 A |
| 2,603,957 | 7/1952 | Brooks | 66/1 A |
| 3,143,868 | 8/1964 | Palange | 66/1 R |

FOREIGN PATENT DOCUMENTS

| | | | |
|---|---|---|---|
| 521894 | 3/1931 | Fed. Rep. of Germany | 66/4 |

*Primary Examiner*—Wm. Carter Reynolds
*Attorney, Agent, or Firm*—Holman & Stern

[57] ABSTRACT

Apparatus for manually producing a knit fabric comprises at least a pair of upright knitting supports with slotted top sections on which the fabric is produced and supported, and at least one curved needle having a pair of yarn-threading eyes, which needle carries yarn from a yarn supply and is manipulated in conjunction with the supports to produce stitches thereon.

4 Claims, 17 Drawing Figures

APPARATUS FOR USE IN PRODUCING KNIT FABRICS

BACKGROUND OF THE INVENTION

This invention relates to apparatus with which manual knitting operations can be performed to produce diverse types of knit fabrics.

It is an object of the invention to provide apparatus of a simple and economical construction which can be used with a minimum of instruction to perform diverse types of knitting operations and produce various different types of knitted fabrics.

It is another object of the invention to provide a knitting apparatus on which different forms of stitches and different knitting patterns can be produced by suitable manual manipulation of hooked needles used in conjunction with stationary knitting supports.

It is still another object of the invention, in one of its aspects, to provide a simple apparatus on which knit fabrics can be readily produced by manual operation, utilizing a plurality of yarns of different color and/or character while minimizing the possibility of such yarns becoming entangled during the knitting process.

It is a further object of this invention, in another of its aspects, to provide an apparatus on which knit fabrics can be produced having different spacing between selected stitches.

It is a still further object of the invention to provide apparatus on which a knitted fabric can be produced and into which velour or like staples can be incorporated to provide a pile fabric.

BRIEF SUMMARY OF THE INVENTION

In accordance with the invention, apparatus for use in producing knit fabrics comprises a plurality of upright supports with axially slotted upper end sections on which stitches are produced and on which the knitted fabric is supported and at least one hooked knitting needle having a pair of threading eyes for carrying a knitting thread or yarn and which is used to manipulate the yarn in conjunction with the stationary supports to produce the stitches.

One preferred embodiment of the invention, particularly useful in producing multi-colored knit fabrics comprises a pair of upright supports of rod-like form mounted on a base frame which has a series of holder devices on each side of the supports for a plurality of hooked needles, each of which needles can carry a thread or yarn from a different yarn supply. In use, the needles are all initially positioned in the holder devices on one side of the supports. When a particular yarn is required for knitting, its needle is manipulated in conjunction with the supports to form the requisite stitches and stitch rows and the needle is then placed in a holder device on the other side of the supports. The process can then be repeated with other selected needles and when all required needles have been moved across from one side to the other, the entire procedure can be reversed.

In another preferred embodiment of the invention particularly useful for producing knit pile fabrics or knit fabrics with variable stitch spacing, the apparatus comprises a series of relatively squat slotted supports arranged in line or around the circumference of a circle. This arrangement is primarily intended for use with a single hooked yarn-carrying needle which is manipulated in conjunction with selected supports in turn to form and support rows of stitches into which velour or like staples can be incorporated if required to form a pile fabric.

BRIEF DESCRIPTION OF DRAWINGS

In the accompanaing drawings, which illustrate the invention by way of example.

DETAILED DESCRIPTION OF PREFERRED EMBODIMENTS

Figure 1:
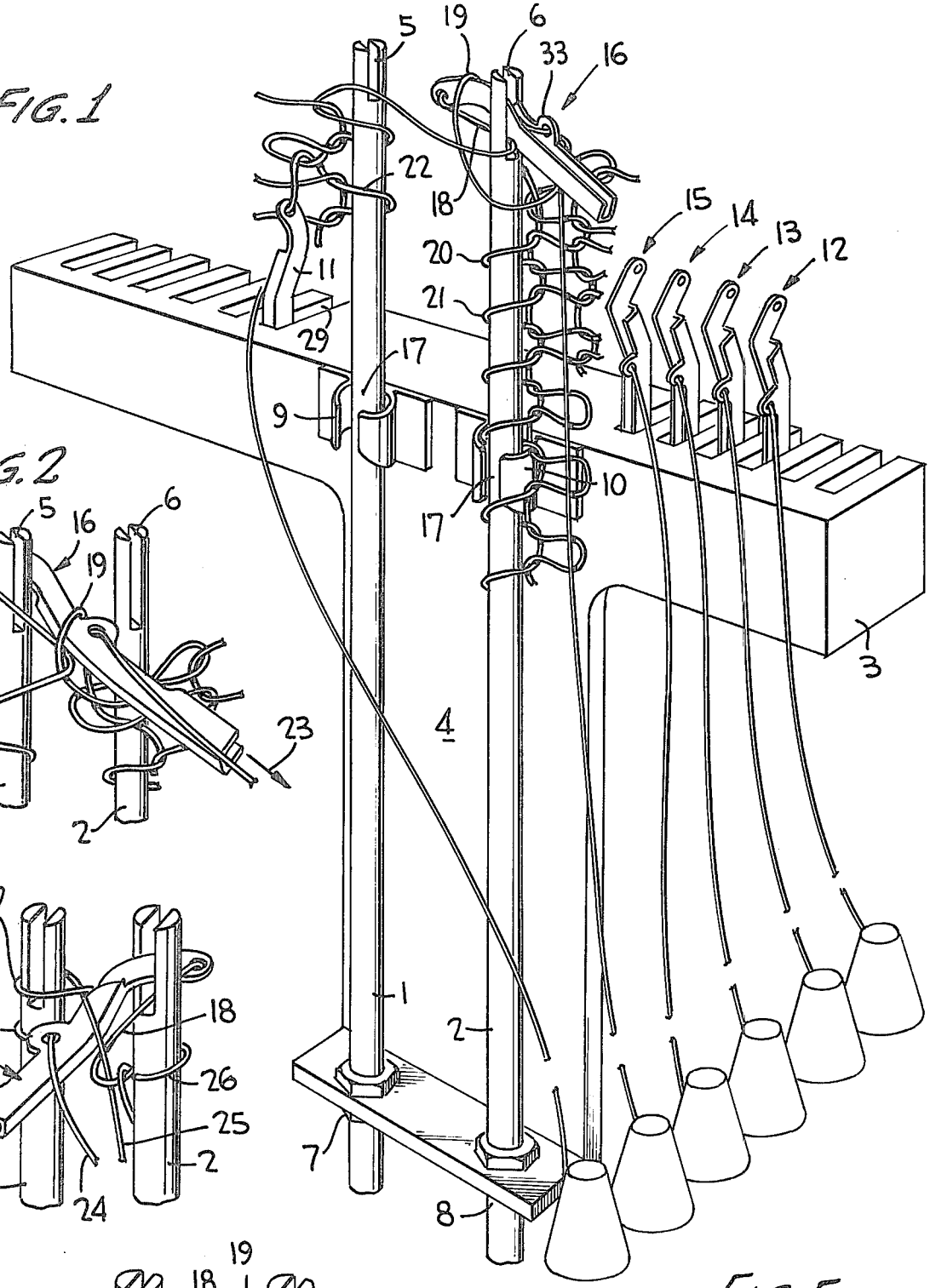
FIG. 1 is a perspective, semi-diagrammatic view of a first form of knitting apparatus shown in the course of stitch production.

The apparatus shown in FIGS. 1–5 comprises two suitably shaped support rods 1 and 2 which act in a similar manner to conventional knitting needles. At their free upper ends, the two rods have longitudinal notches or slots 5 and 6, 2 to 3 centimeters long. The rods themselves are about 30 to 40 centimeters long and pass through two collets 9 and 10 attached to a base member support 3. The rods themselves are secured to a downwardly depending lower section of the base member at locations 7 and 8. The two collets are open at the front as shown and have a diameter greater than the rods so that the rods can slide in the collets when they hold a knit fabric. The dimensions of the longitudinal openings 17 of the collets are such as to let the manufactured knitting on the rods pass through the collets while preventing the rods themselves from passing through the openings. The support 3 has an elongate form in the horizontal plane and to the right and left of the rods, the support has an upper section formed an equal number of grooves forming holders for a plurality of hooked needles 11–16 each of which carries the yarn from a separate cone or ball as diagrammatically shown in FIG. 1.

Figure 5:
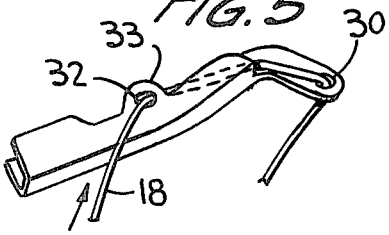
FIG. 5 is a side view of the forward end of one of the yarn-carrying needles of the FIG. 1 apparatus.

The hooked needles 11–16 as shown in FIG. 5 have substantially planar, curved forward ends and have a pair of eyes 30 and 32, eye 30 being located at a forward tip of the needle and eye 32 being located at the rear of the curved forward end on a projecting portion 33 of the needle. As clearly shown the eyes each have an axis perpendicular to the plane of the curved forward end of the needle. Further, the needles are channel-shaped in cross section up to an intermediate point approximately at the crest of the curved portion and the remainder of the curved portion up to the tip is an extension of one wall only of the channel. The needles are threaded with the yarn 18 from a yarn supply first through eye 32, the yarn then extending along the needle channel and passing through eye 30 onto the rods 1 and 2.

In operation, as shown in FIG. 1, there are six needles, 11, 12, 13, 14, 15 and 16 which can be used with different yarns as to color and/or quality. For knitting, each needle is manipulated with the rods 1 and 2 in turns according to the pattern and the type of knitting fabric to be obtained. When one needle has completed a knitting operation, it is deposited in a groove on the support 3, on the side opposite that from which it was taken before starting the knitting operation. In FIG. 1 needle 11 is shown with the yarn which has already been used and put down in groove 29. While this needle was in operation, the other needles 12, 13, 14, 15 and 16 were deposited in grooves on the right of the rods 1 and 2.

Figure 2:
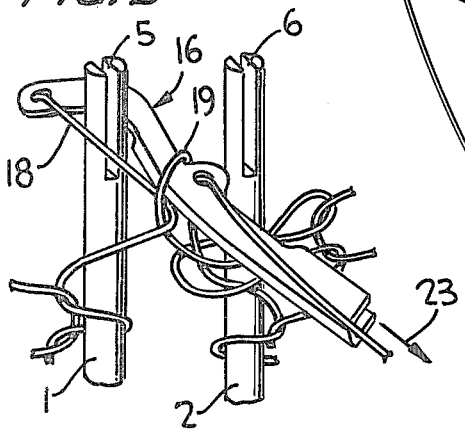
FIGS. 2, 3 and 4 are detailed perspective views of part of the apparatus of FIG. 1 shown in different stages of stitch production.

FIG. 1 shows needle 16 in the process of forming a stitch, the needle being shown in the position it occupies when taking over a loop 19 present on rod 2. To do this, the needle must be introduced by its tip into notch 6 of rod 2, and to carry out this operation it should be noted that before the tip of the needle goes beyond the notch, the loop 19 has been moved upwardly, so that the tip of the needle can hook the loop in question. Then, the needle is raised so that the loop 19 leaves the rod 2 and remains on the needle held by the needle projection 33. In FIG. 2, the stitch has been passed onto needle 16 and the needle with stitch 19 is then moved over to rod 1 so that the rod is introduced between the curve of the needle and the section of the yarn 18 coming from the ball. Then the needle is pulled in the direction indicated by arrow 23, so that section of thread 18 remains hooked on rod 1 and loop 19, previously from rod 2, leaves the needle and is cast off into the knit fabric. The needle, having formed the stitch, is free to carry out the same operation on loop 20, and then on loop 21 and all the way down the row of stitches on rod 2. When the hook has completed the row, it is deposited in the groove next to needle 11 and the same operation is repeated with one of the needles 12, 13, 14 or 15. When all of the needles have been used to take stitches from rod 2 and cast them off onto rod 1, the needles have been deposited into grooves on the side of rod 1. The work is then turned around and the operation is repeated taking stitches from rod 1 and casting them off onto rod 2 and passing the needles into the grooves on the side of the rod 2.

It will be understood that the apparatus can be operated with more or less needles than the six shown in FIG. 1 (depending on the number of different yarns to be used) and if only a single yarn is to be used, knitting can be performed with a single needle.

Figure 3:
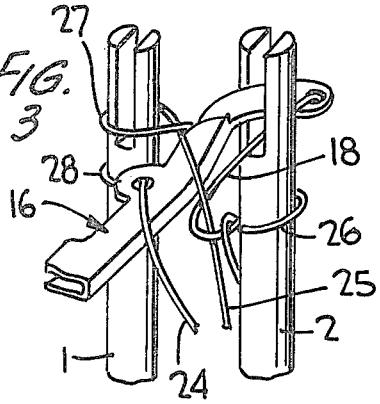

A method of joining two adjacent loops formed by two threads coming from different supplies of different color or quality is shown in FIG. 3. Thread 25 has already made loops 27 and 28 and the respective needle is not shown in the drawing. The thread 24 carried by needle 16 must, before it takes up loop 26, be passed under thread 25, then the operation of casting on and off of the stitch is carried out, taking loop 26 and then casting off the section of thread 18 on rod 1 in the same manner as explained above. After this operation has been carried out, needle 16 is brought back by pulling it from below thread 25 and in executing this operation the hand should not let go of the needle. Stitches formed by threads 24 and 25 are thus joined while the respective threads have not crossed but have remained parallel down to the thread supplies. This operation is repeated whenever needles are changed.

Figure 4:
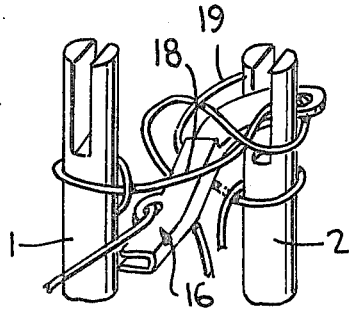

Forming a purl stitch as shown in FIG. 4 differs from the formation of a plain stitch as described above in only one detail, which is that the tip of needle 16 takes the loop 19 not from above, but from below.

To reduce the number of stitches in a row by one stitch a needle must take two loops together and cast only its own thread onto the other rod. To increase the number of stitches in the row by one stitch, the hook must not take any loop off the rod from which it casts off, but with its thread must form a new loop on the loading rod.

Figure 6:
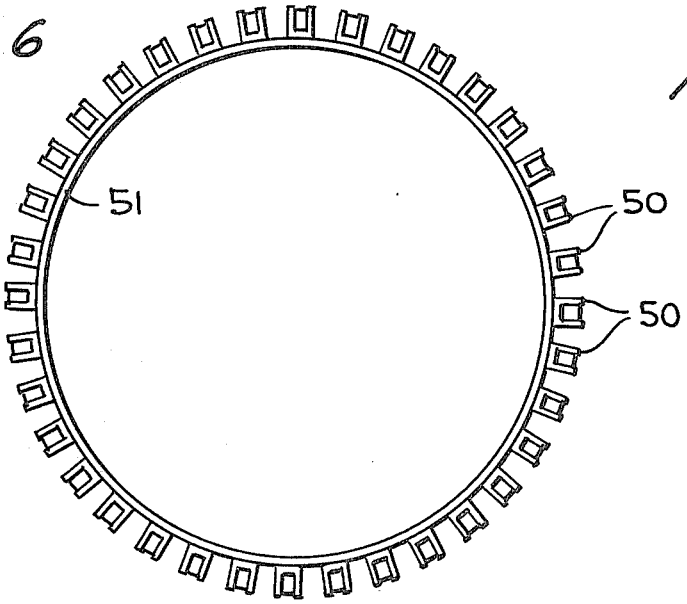
FIGS. 6 and 7 are respectively a plan view and an elevation of a support structure of a second form of knitting apparatus.
Figure 7:
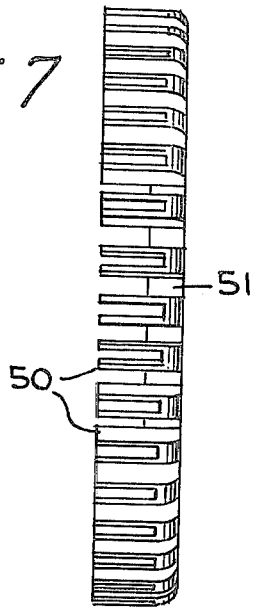
Figure 13:
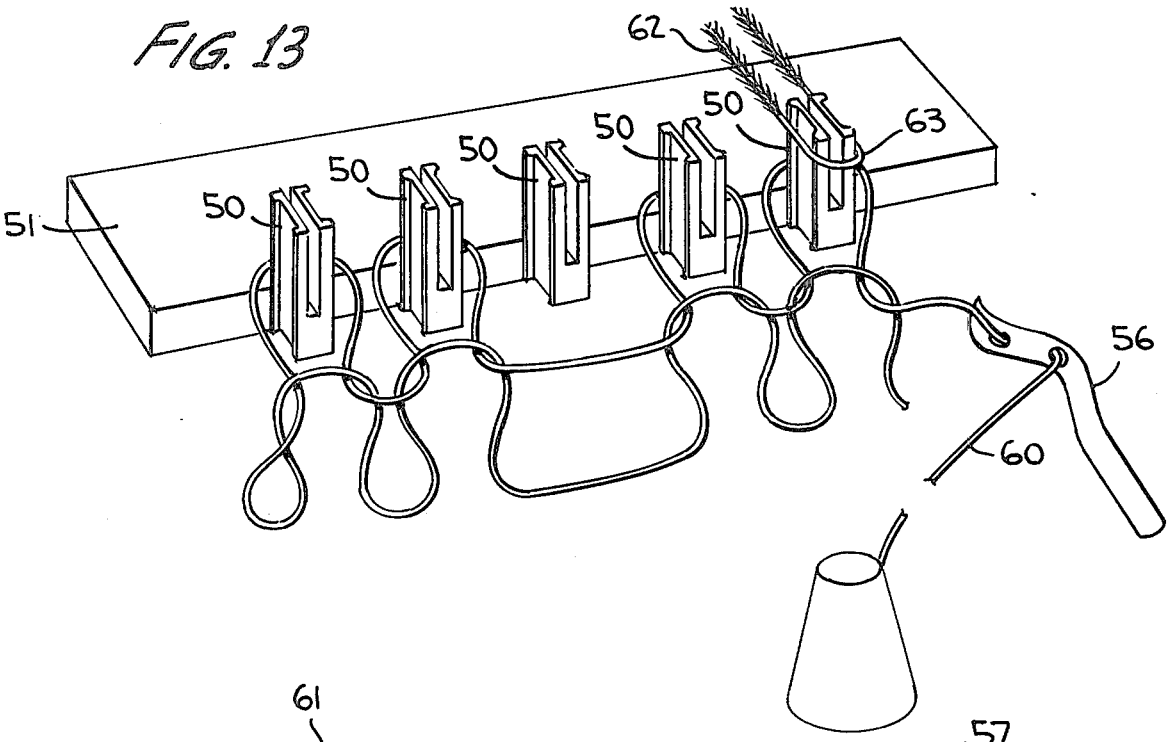
FIG. 13 is a perspective view of a further form of knitting apparatus of the type shown in FIGS. 6 and 7.

FIGS. 6–17 illustrate an alternative form of apparatus in accordance with the invention which employs a series of knitting supports 50 arranged in spaced relation on a base member 51 either around the periphery of the circle as shown in FIGS. 6 and 7 to produce tubular knit fabrics, or in a line as shown in FIG. 13 to produce knit fabric in sheet form. This type of apparatus is primarily intended for use with a single hooked needle 56 and can be operated to produce fabrics having a variable stitch spacing by omitting one or more supports as shown in FIG. 13 or to produce pile fabrics by the incorporation of staples as shown in FIGS. 14–17.

Figure 9:
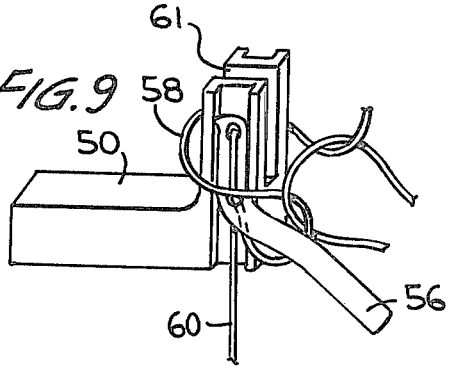
Figure 10:
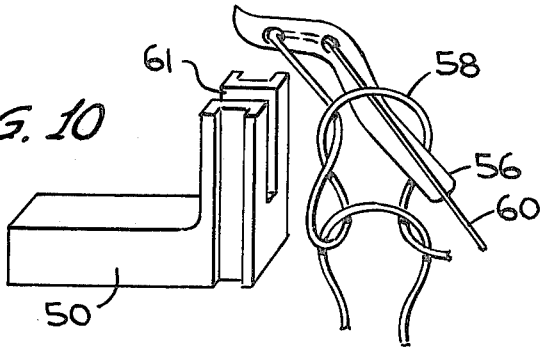

The supports 50 again have longitudinal slots 61 in their free upper ends and the outer faces are longitudinally grooved as shown to facilitate needle insertion as shown for example in FIG. 9. Needle 56 is similar in form to the needles described with reference to FIGS. 1–5 and has a substantially planar curved forward end with a pair of spaced eyes with axes perpendicular to that plane of the forward end and with yarn from a ball being threaded in use through the rear eye and then through the forward eye as shown. In this embodiment, however, the rearward eye of the needle is shown as being located substantially on the crest of the curved forward end of the needle.

In use, stitches are formed successively on individual supports by suitable manipulation of yarn-carrying needle 56, with the needle 56 carrying thread 60 from a supply having the function of taking loops off the supports 50 and discharging them into the fabric, at the same time preparing on the supports a new row of stitches for the next course. To take loops from the supports one or other of two different operating modes may be used.

Figure 8:
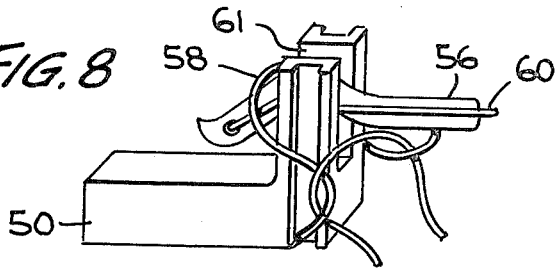
FIGS. 8–12 are perspective views of a support of the apparatus of FIGS. 6 and 7 shown in progressive stages of stitch production.
Figure 11:
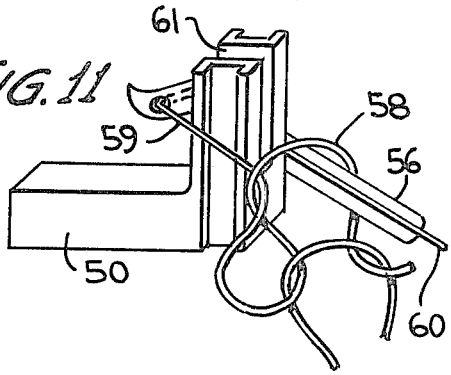
Figure 12:
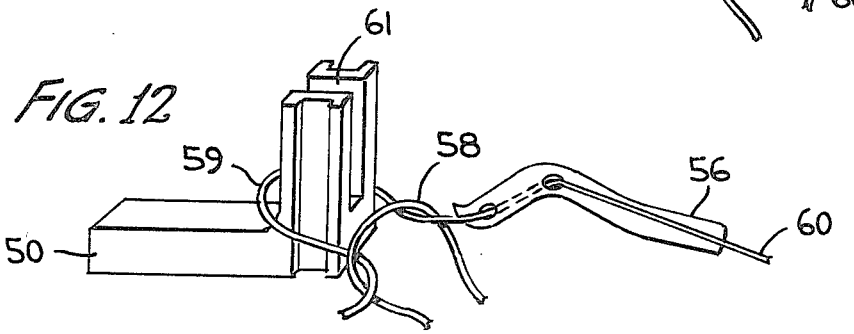
Figure 14:
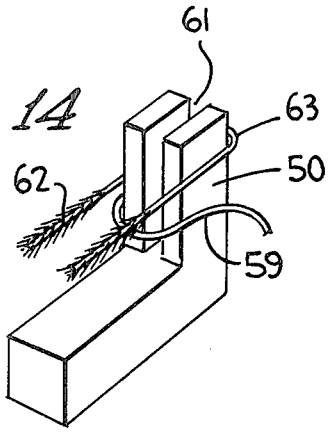
FIGS. 14–17 are perspective views of one of the supports showing progressive stages in the incorporation of a velour or like staple into a stitch to produce a pile fabric.
Figure 15:
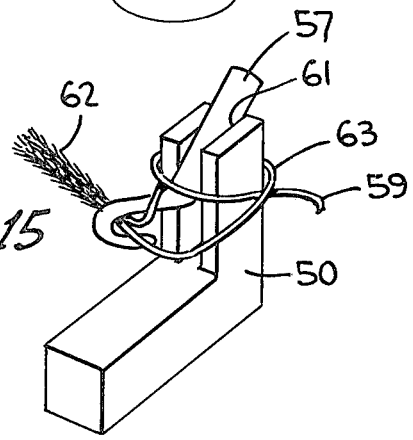
Figure 16:
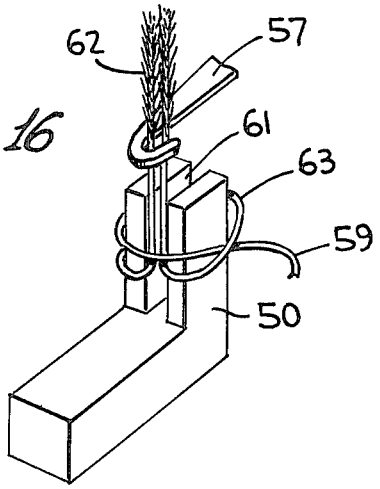
Figure 17:
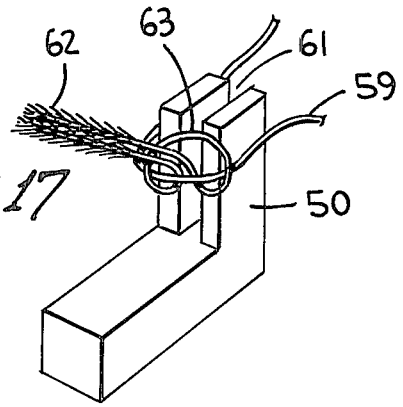

In FIG. 8, for example, needle 56 has been introduced in notch 61 with the needle tip under loop 58 of a previously formed stitch. Alternatively, (FIG. 9) the needle can be introduced under loop 58 but upside down and on the outside of the support. After having operated by one of these two modes, the needle is raised from the support together with loop 58 (FIG. 10) leaving the support empty. In FIG. 11 the needle has been lowered again so that its thread 59 coming out of the tip of the needle is arranged around the perimeter of the support. Subsequently, FIG. 12, the needle is pulled back so that loop 58 leaves the needle and is released into the already formed knit fabric and the section of thread 59 forms a new loop around the perimeter of the support. This operation is then repeated on selected succeeding supports returning to the support first operated on. As shown in FIG. 13, the central support has been excluded from the operation to obtain greater spacing between a pair of stitches. In the arrangement shown in FIGS. 6 and 7, there are thirty-six supports to form a row with a maximum of thirty-six stitches. This operation can be operated leaving one or more supports idle in order then to return to them in the same row or in one of the following rows, or one can operate several times on the same supports. Also circular knitting can be effected. To produce pile fabrics, the procedure for adding pile staples to the knit fabric is shown in FIGS. 13–17. In FIGS. 13 and 14 a staple 62/63 has been placed on a support 50 above loop 59 which forms part of the fabric already knitted. In FIG. 15 a separate hook 57, not carrying other yarn, has been introduced with its tip under loop 59. Then the two ends of the staple are hooked to the hook. In FIG. 16 the hook protected by the two walls of notch 61 has been pulled above the support together with the two ends of the staple, without running into the loops to be protected which are present on the outside of the walls of the support. In FIG. 17 the part of the staple 62 which forms a loop 63 has been raised and hence freed from the support, so that a knot can be formed held only by loop 59. The knot having been formed, knitting is resumed as in FIGS. 8–12 thereby incorporating a pile staple into the knit fabric.

While the present invention has been described with reference to particular embodiments thereof, it will be understood that numerous modifications can be made by those skilled in the art without departing from the scope of the invention as defined in the appended claims.

I claim:

1. Apparatus for use in producing knit fabrics comprising a base member, at least two elongate upright knitting supports on said base member, means defining a slot in each support extending longitudinally from a free upper end thereof and at least one needle for use, when threaded with yarn from a yarn supply, in forming stitches on the supports, said needle comprising a curved forward end terminating in a tip, a first yarn-threading eye located substantially in the region of said tip and a second yarn-threading eye spaced rearwardly along the needle from said first eye, wherein said supports consist of a pair of rods, said base member comprising an upper section and a lower section depending from said upper section, a pair of collets mounted on said upper section, said collets loosely receiving said rods and being provided with openings allowing sliding movement of knit material along said rods, and means attaching said rods to said lower section at ends of said rods remote from said slots.

2. The apparatus of claim 1, wherein said upper section of said base member is provided on opposite sides of said rods with a plurality of holders each for accommodating one of said needles.

3. The apparatus of claim 1, wherein said second eye of said at least one needle is located rearwardly of said curved forward end of the needle.

4. The apparatus of claim 1, wherein said at least one needle comprises a part which is channel-shaped in cross-section, said part extending up to an intermediate point of said curved forward end and one wall only of said channel-shaped section is extended to form said tip.

* * * * *